United States Patent [19]

Siegel

[11] Patent Number: 4,645,418

[45] Date of Patent: Feb. 24, 1987

[54] FLUID PUMP

[75] Inventor: Arthur D. Siegel, Cheshire, Conn.

[73] Assignee: Farrel Corporation, Ansonia, Conn.

[21] Appl. No.: 699,501

[22] Filed: Feb. 8, 1985

Related U.S. Application Data

[63] Continuation of Ser. No. 535,809, Sep. 26, 1983, abandoned.

[51] Int. Cl.[4] ..... F04D 3/00; B29B 7/24

[52] U.S. Cl. ..... 415/199.5; 366/98; 366/99

[58] Field of Search ..... 415/199.5, 199.1, 198.1; 366/97, 98, 99, 302, 303, 279; 425/208, 202

[56] References Cited

U.S. PATENT DOCUMENTS

| | | | |
|---|---|---|---|
| 3,153,688 | 10/1964 | Marshall | 366/98 |
| 3,941,355 | 3/1976 | Simpson | 366/99 |
| 3,947,172 | 3/1976 | Myers | 425/376 X |
| 4,021,024 | 5/1977 | Stasi | 366/97 |
| 4,136,969 | 1/1979 | Meyer | 366/99 |
| 4,213,709 | 7/1980 | Valsamis | 425/376 B X |
| 4,227,816 | 10/1980 | Hold et al. | 425/204 X |
| 4,255,059 | 3/1981 | Hold et al. | 366/97 |
| 4,336,213 | 6/1982 | Fox | 425/376 B X |
| 4,421,412 | 12/1983 | Hold et al. | 366/97 |

FOREIGN PATENT DOCUMENTS

| | | | |
|---|---|---|---|
| 2744186 | 4/1978 | Fed. Rep. of Germany | 425/376 B |
| 338240 | 7/1972 | U.S.S.R. | 366/99 |

*Primary Examiner*—Robert E. Garrett
*Assistant Examiner*—John Kwon
*Attorney, Agent, or Firm*—G. Kendall Parmelee; George W. Rauchfuss, Jr.

[57] ABSTRACT

Apparatus for pumping/pressurizing fluid materials such as viscous liquid polymers in which a shaft is provided with one or more blades which extend into and rotate in one or more annular channels. Inlet grooves conduct the liquid material through grooves in the shaft into the channel behind each blade. The walls of the channel apply a drag force to the material and the advancing blade pressurizes the material which is forced through axial grooves in the shaft to another pumping channel, or to an outlet. Close running fits or dynamic seals between the shaft and its bearings provide seals at opposite sides of each channel.

21 Claims, 9 Drawing Figures

FLUID PUMP

This application is a continuation of application Ser. No. 535,809, filed Sept. 26, 1983, now abandoned.

FIELD OF THE INVENTION

This invention relates to a pump for viscous fluid.

DESCRIPTION OF THE PRIOR ART

It is known in the polymer processing field that after processing polymer by melting, mixing, devolatilizing and the like any processing apparatus used must be capable of generating pressure in the viscous liquid material sufficient to extrude the polymer through a shaping die or pelletizing plate or merely to transfer the material to another processing device.

In a screw type processor, a screw running in a bore is generally provided with channels of reduced cross section such as caused by channels of diminished depth or by varying the pitch of the screw in order to generate increased pressure. A screw having reduced depth typically is shown in U.S. Pat. No. 3,023,456. Melting, mixing devolatilizing and other operations are performed in relatively wide channels at relatively low pressure. The viscous liquid polymer, however, is usually pressurized for pumping in relatively narrow channels which requires considerably greater expenditure of energy than the other processing channels.

Accordingly, it is an object of the invention to provide a device for pumping viscous fluid with a significantly less expenditure of energy and resultant lower costs.

SUMMARY OF THE INVENTION

The present invention provides a novel device for pumping viscous fluids. The pump includes a body member having a central bearing in which a shaft rotates. The shaft is provided with one or more radial blades which are received for rotation in one or more annular channels. At the base of each blade, the shaft is provided with a groove which extends generally axially along the shaft from an inlet through which the viscous fluid is supplied to a recess behind the blade and which also communicates with the annular channel. As the shaft and blade rotate, the viscous fluid builds up behind the blade and as the channel fills, the leading side of the blade engages the bank of material. Since the fixed walls of the channel apply a drag to the material, pressure is built up by the advancing blade causing the material to be forced from the channel through another groove in the shaft leading from the root of the front side of the blade to an outlet or to the backside of a successive blade on the shaft to repeat the operation and further raise the pressure on the material. To avoid uneven stresses and deflection of the shaft, the blades may be arranged equally spaced around the shaft or at diametrically opposite sides of the shaft. With this arrangement leakage from the unit can be minimized by a close clearance between the shaft and a relatively close fitting bearing. To eliminate leakage the shaft surface can be formed to act as a dynamic seal using the viscous polymer to fill the clearance. The inlet and outlet grooves pass through the bearing/sealing areas.

DESCRIPTION OF PREFERRED EMBODIMENTS

Figure 1:
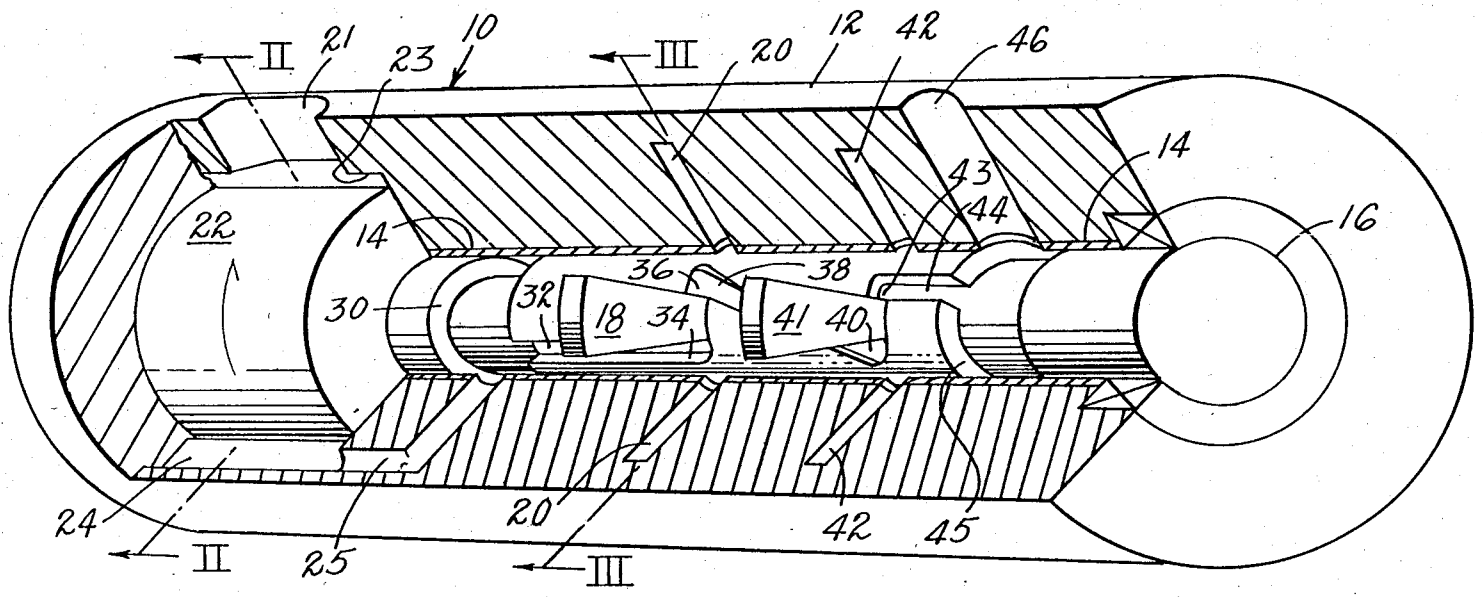
FIG. 1 is a schematic perspective view of a polymer processing device embodying the pump of the present invention.

Referring to FIG. 1, there is shown a polymer processing unit 10 embodying the pump of the present invention. The unit includes a body 12 having a central bearing 14 which receives a shaft 16. The shaft has fixed thereto one or more radially extending blades 18 which are received in an annular channel 20 in the body 12. At one end, the body is provided with an inlet 21 which leads to the surface of a drum 22 on one end of the shaft 16.

Figure 2:
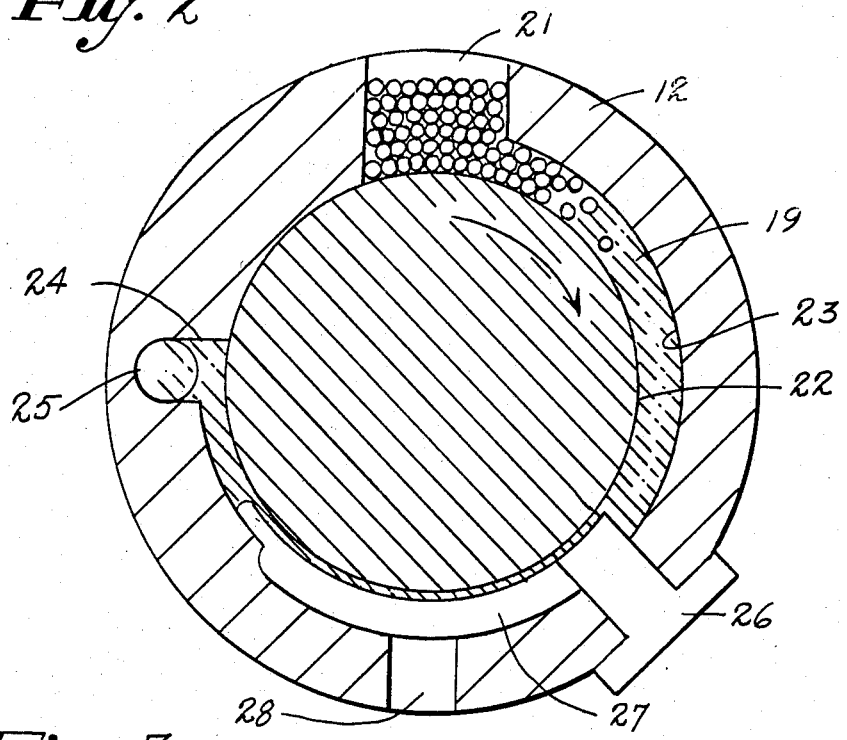
FIG. 2 is a section on line II—II of FIG. 1.

As best seen in FIG. 2, solid thermoplastic pellets or liquid polymer may be fed into inlet 21 and as the drum 22 is rotated by a source of rotary power (not shown) the liquid polymer or pellets are fed along a space 19 between the surface of the drum and a cylindrical surface 23 of the body. To melt the thermoplastic pellets, the drum and/or the body 12 may be heated in any suitable manner not shown but which may be by circulation of fluid and/or electrical band heaters both of which are well known in the art. The pelletized polymer is progressively melted and fed toward a collection recess 24 leading to a channel 25. As is well known in the art a partial dam 26 may extend into the space 19 to spread the liquid or melted polymer on the surface of the drum forming a void 27 downstream of the dam. A port 28 extends through the body 12 into the void 27 so that volatile gasses may be drawn therefrom or additives may be introduced thereto. The melted polymer collects in the recess 24 and sufficient pressure is generated to cause the polymer to flow along the channel 25 (FIG. 1) in the body 12 and into an annular groove 30 in shaft 16. An axially extending groove 32 in the shaft leads the liquid polymer into a recess 34 behind and at the base of the blade 18 (See also FIG. 3). As the shaft rotates and blade 18 sweeps along the annular channel 20 the polymer continues to be fed into and fill the channel 20. The stationary walls of the channel apply a drag on the polymer and the advancing blade causes the pressure in the polymer to rise and force the polymer into a recess 36 ahead of the blade and along a groove 38 in the shaft.

As shown in FIG. 1, the pressurized polymer flows along the groove 38 into a recess 40 at the base of a second blade 41 also fixed to the shaft 16 and extending radially into an annular channel 42 similar to channel 20. The already pressurized polymer fills channel 42 and the advancing blade 41 further pressurizes the material which is forced into a recess 43 at the base of the leading side of the blade and along a groove 44 in the shaft and into an annular groove 45. The pressurized polymer is led from the groove and the unit through a port 46 into any suitable apparatus (not shown) for further processing such as extrusion or molding into shapes or for pelletizing. Such further apparatus could include devices for injection molding without departing from the scope of the invention.

Figure 3:
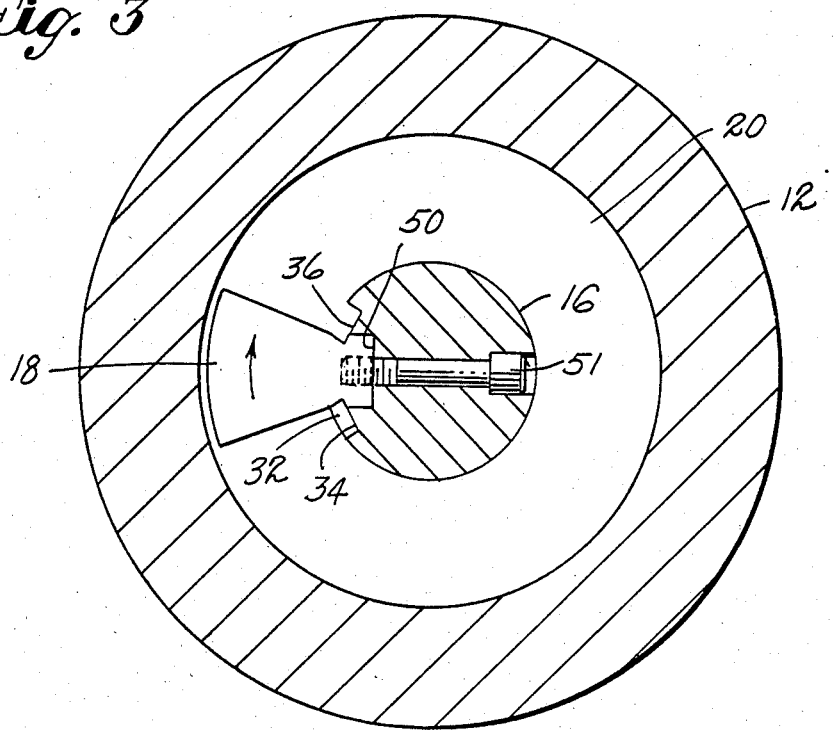
FIG. 3 is a section on line III—III of FIG. 1.
Figure 5:
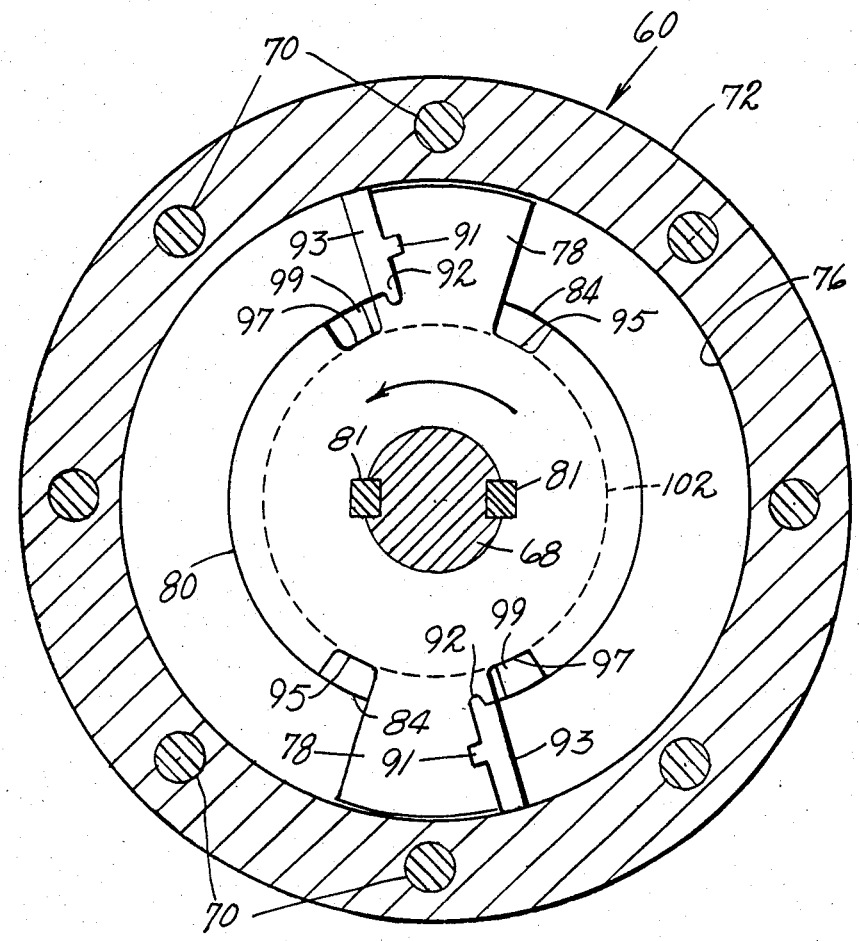
FIG. 5 is a section on line V—V of FIG. 4.
Figure 8:
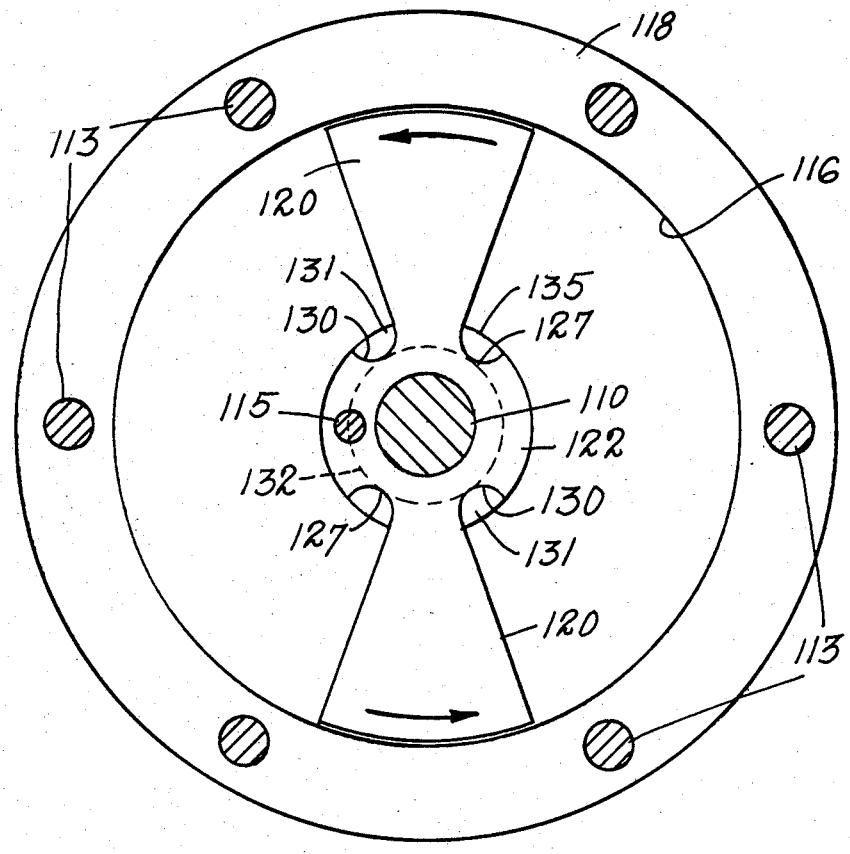
FIG. 8 is a section on line VIII—VIII of FIG. 7.
Figure 9:
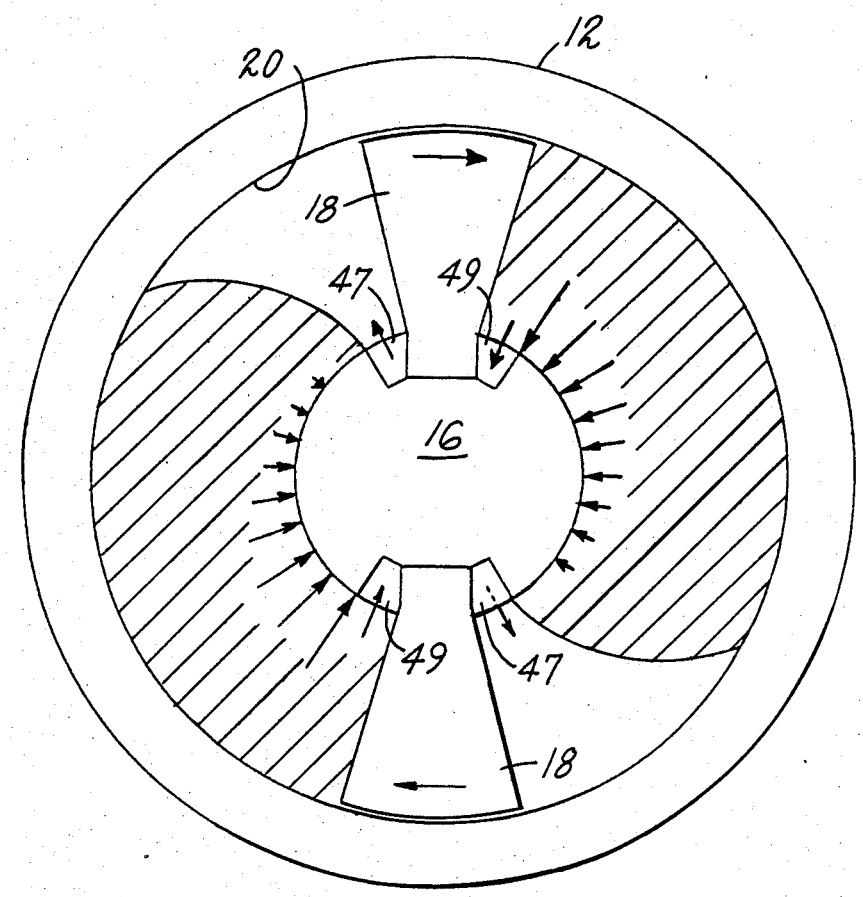
FIG. 9 is a cross section of a pumping unit diagrammatically illustrating the balancing effect caused by diametrically opposite blades.

As shown in FIG. 3, the base of the blade 18 may be received in a recess 50 in the shaft 16 and secured by a bolt 51 which extends through the shaft. So that the forces acting on the shaft 16 can be balanced to minimize undesirable deflection forces on the shaft, the blades 18 and 41 can be arranged on opposite sides of the shaft or could be constructed as seen in FIGS. 5 and 8 to balance forces in each annular channel as shown graphically in FIG. 9. As illustrated in FIG. 9, the forces which build up progressively from the inlet grooves 47 to the outlet grooves 49 are balanced by equal and opposite forces.

Figure 4:
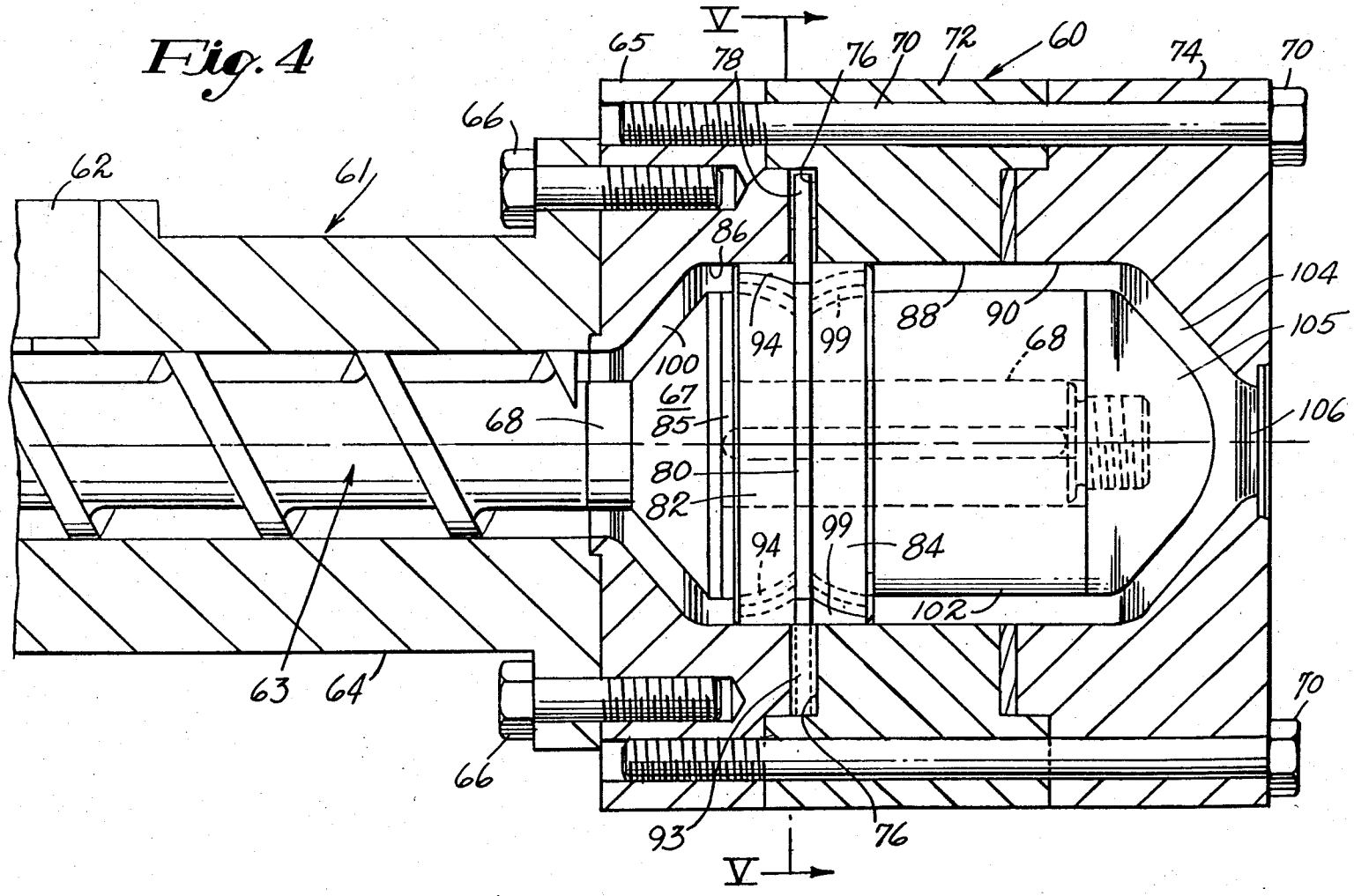
FIG. 4 is a longitudinal section through an alternate form of polymer processing device embodying the invention.
Figure 6:
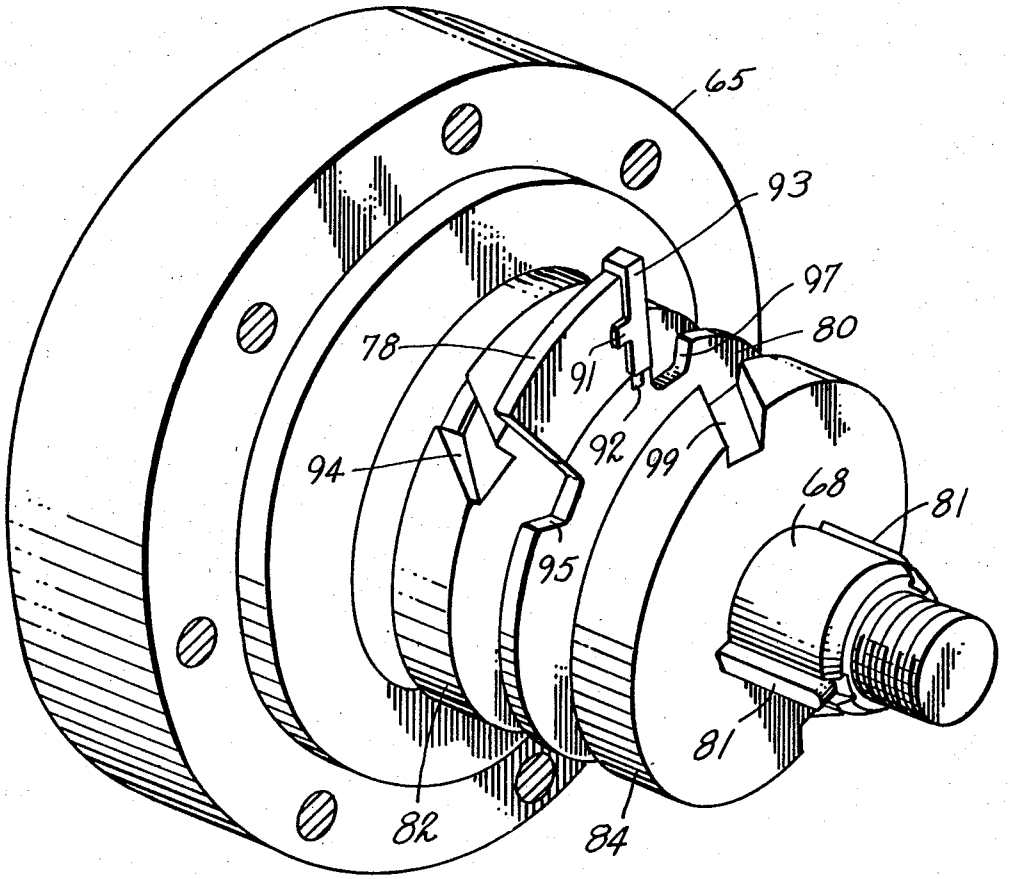
FIG. 6 is an exploded perspective view of parts of the pump unit of FIG. 4.

Referring to FIG. 4, there is shown an alternate form of polymer processor embodying the invention. The unit includes an alternate preferred form of pump 60 which could be attached to and be fed fluid polymer by any one of a number of processors including a melting screw unit 61 as seen in FIG. 4, or the drum type shown in FIGS. 1 and 2. As seen in FIG. 4, polymer already in liquid form or in pellet form is fed through an inlet 62 to the single or multiple flights of a screw 63 which is rotated by a source of rotary power (not shown). The body 64 and/or the screw 63 may be heated by suitable means (not shown) to melt or otherwise process the polymer which is fed by the screw toward the pump unit 60. The liquid polymer is fed from the end of the screw to a passage 100 formed between a conical recess in an end frame 65 and a conical flange 67 on a shaft 68 fixed to the end of screw 63. The end frame 65 of the pump 60 is secured by bolts 66 to a flange on the end of unit 61 and in turn is secured by through bolts 70 to a stepped body 72 and a header 74. A recess between mating surfaces of the frame 65 and body 72 forms an annular channel 76 which receives blades 78 extending radially from a hub 80 mounted on shaft 68 and fixed for rotation with the shaft by keys 81. Two sealing collars 82, 84 and spacer 85 locate the hub 80 and blades 78 along the shaft 68 so the blades 78 are received in the channel 76. The collars 82, 84 are received with a close sealing but running fit in aligned bores 86 and 88 in the frame 65 and body 72 respectively. An impeller block 93 is mounted on each blade for relative movement in axial directions via key slots 91, 92 and closely fits the cross sectional area of the channel 76. This arrangement permits differential axial expansion between the pump body parts and the rotor parts on the shaft 68 without interference. The upstream collar 82 is provided with diametrically opposite helical grooves 94 (see also FIG. 6) which lead to the channel 76 through recesses 95 at the base of the trailing sides of the blades 78. The helix angle of the grooves is adapted to facilitate the flow of the liquid to be pumped.

During the operation of the processor the screw 63 is rotated by means not shown and feeds liquified polymer along the screw, through the passage 100 and in divided streams through grooves 94 and recesses 95 into the annular channel 76 behind the blades 78. It should be apparent that liquid polymer could be fed to the passage 100 from any suitable source other than the screw 63 without departing from the scope of the invention. The hub 80 and blades 78 are rotated with the screw 63 and, when the channel 76 fills, the advancing impeller blocks 93 pressurize the material in the channel forcing the material through recesses 97 at the base of the leading side of each blade and through helical grooves 99 in the sealing collar 84. The liquid polymer then is forced through an annular passage between the aligned bores 88 and 90 and a collar 102 and through a passage 104 between a conical nose 105 and a recess in the header 74 to an outlet 106. The outlet can be used for die extrusion or may lead to other processing devices.

It should be apparent that one or a series of impeller blades and annular channels could be provided in serial fashion axially along the shaft 68 to provide additional pumping facilities without departing from the scope of the invention.

Figure 7:
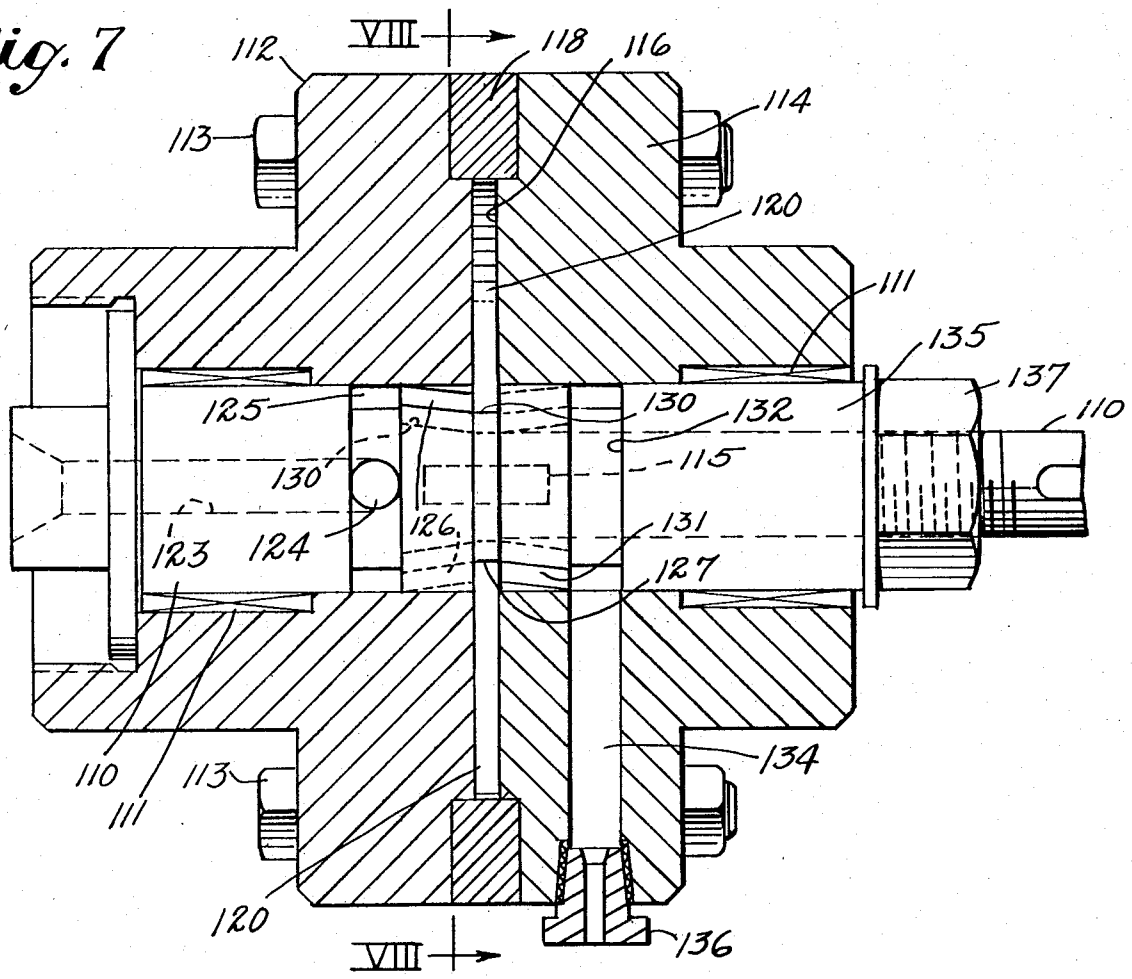
FIG. 7 is a longitudinal section through an alternate form of pumping unit.

Referring to FIGS. 7 and 8, a further embodiment of the pump is shown. As seen a shaft 110 is mounted for rotation in bearings 111 formed in a pair of mating body members 112, 114 which are secured together by bolts 113. An annular channel 116 is formed between the members by an appropriate spacer 118. Blades 120 extend from a hub 122 secured to the shaft 110 by a shear pin 115 are rotatable in the channel. Liquid polymer is fed into the channel through a central bore 123, a passage 124, an annular groove 125, grooves 126 and recesses 127 at the base of the trailing side of each blade 120. The pressurized polymer is led through recesses 130 at the base of the leading side of each blade 120 and through grooves 131 to an annular groove 132 in a collar 135 on the shaft and then through an outlet 134 to a nozzle 136 or other suitable processing devices. The assembly on the shaft is secured by a nut 137 threaded on the shaft.

Experimental tests were run using a pump having a blade diameter of nine (9) inches running at 1OORPM in a channel having a 0.25 inch width. The experimental pump successfully pumped polystyrene, HDPE, LDPE, polypropylene and ABS using a 3.5 inch diameter screw melter similar to that shown in FIG. 4 to feed liquid polymer to the pump. LDPE was pumped at the rate of 502 lbs/hr at 1200 psi with specific energy use of 0.033 HP hr/lb. (The specific energy was based on motor amperage and includes motor and gear drive losses plus energy consumed by the feed screw which had a capacity of 500 lbs/hr.) HDPE was pumped with the rotor speed lowered to reduce the melt temperature at a rate of 153 lbs/hr. at a pressure of 2400 psi with specific energy use of 0.06 HP-hr/lb.

In other tests two pumping stages were operated in series with the channel widths reduced to 0.20 inch to increase efficiency. It was found that the pressure generated nearly doubled with the specific energy used remaining about the same. Tests analysis indicate that the novel pump is more efficient with specific energy use of 0.032 HP-hr/lb. than a comparable screw extruder at 0.044 HP-hr/lb.

Little energy savings are expected at such low flow rates. However, it is indicated that substantial energy savings can be realized using larger pumps at higher flow rates, and pressures in excess of 3000 psi can be reached with low density polyethylene. This means that there is a significant potential of replacing metering sections of conventional feed screws or other processing units such as shown in FIG. 1 with more efficient pumping sections as herein described that occupies less space and uses less energy.

It should be apparent that while the pumping/pressurizing unit has been described with relation to polymer processing apparatus, the novel unit is equally useful to pump/pressurize any fluid including liquids and pastes from any source which have viscosity high enough so the walls of the annular channels provide a drag on the material. Obviously, the pumping channels, which are shown herein as generally rectangular in shape, could have a variety of shapes including rounded as well as wedge shapes without departing from the scope of the invention defined by the appended claims. The various processing units combined with the pump/pressurizing units have been described by way of illustration and not for limiting the usefulness of the novel pump/pressurizing units. The foregoing descriptions have been related to devices which are shown more or less in a diagrammatic or schematic manner and various substitutions of parts and combinations could be made without departing from the scope of the invention.

I claim:

1. A pump for viscous fluid including a body having an inlet for supplying viscous fluid, a central cylindrical bearing and at least one concentric annular channel opening only at the bearing, a relatively close fitting shaft rotatable in said bearing and having at least one radial blade complementary to the cross section of the channel and rotatably received in the channel, a first groove in the shaft extending generally axially from the inlet through the bearing to an area behind the blade considered in the direction of rotation of the shaft and blade and communicating with the channel, a second groove in the shaft extending through the bearing from in front of the blade generally axially toward an outlet and communicating with the channel, said shaft and said bearing substantially closing said channel but for said opening provided by said first and second grooves, the fluid entering behind the blade through the first groove progressively filling the channel as the shaft and blade rotate and the advancing blade engaging and forcing the fluid in the channel through the second groove toward the outlet.

2. A pump according to claim 1 in which each blade is smaller in width than the corresponding channel and has keyed thereto for axial sliding movement a block forming the leading side of the blade and of a size and shape substantially complementary to the cross section of the channel.

3. A pump according to claim 1 in which a plurality of blades are spaced equally around the shaft to balance forces applied to the shaft.

4. A pump according to claim 3 in which the shaft has diametrically opposed blades extending into the channel and a set of first and second grooves extending to and from each blade.

5. A pump according to claim 3 in which the body has at least a second channel axially spaced from the one channel and receiving a second set of blades and the second groove extends from in front of each blade to the second channel behind each of the second blades and a third groove in the shaft extends from in front of each of the second set of blades toward the outlet.

6. A pump according to claim 3 in which each blade is smaller in width than the corresponding channel and has keyed thereto for axial sliding movement a block forming the leading side of the blade and of a size and shape substantially complementary to the cross section of the channel.

7. A pump according to claim 1 in which the body has at least a second channel axially spaced from the one channel and receiving a second set of one or more blades and the second groove extends from in front of said one blades to the second channel behind each of the second set of blades and a third groove in the shaft extending from in front of each of the second set of blades toward the outlet.

8. A pump according to claim 1 in which seals are formed at opposite sides of the channel by fluid between the bearings and the shaft to minimize passage of pressurized fluid to and from the channel except through said grooves.

9. A pump for viscous fluid including a body having bearings receiving a shaft for rotation, a hub mounted on the shaft for rotation therewith and having equally spaced blades extending radially into an annular channel in the body coaxial with the shaft, the shaft having a groove extending generally axially from a source of fluid through the bearing and opening into the channel at the base of the backside of each blade considered in the direction of rotation of the shaft, the fluid progressively filling the channel at the backside of each blade as the shaft and blades rotate, the advancing blades engaging the fluid in the channel thereby raising the pressure of the fluid for forcing the fluid through another groove in the shaft opening into the channel and extending generally axially from the base of the front side of each blade toward an outlet, said shaft and said body substantially closing said channel but for said openings provided by said grooves in said shaft.

10. A pump according to claim 9 in which the body has at least a second channel axially spaced from the one channel and receiving another set of said blades and said another groove extends from in front of said other set of blades to the second channel behind each blade of the other set of blades and a third groove in the shaft extending from in front of each of the other set of blades toward the outlet.

11. A pump according to claim 10 in which seals are formed at opposite sides of each channel by fluid between the bearings and the shaft to minimize passage of pressurized fluid to and from each channel except through said grooves.

12. A pump according to claim 9 in which each blade is smaller in width than the corresponding channel and has keyed thereto for axial sliding movement a block forming the leading side of the blade and of a size and shape substantially complementary to the cross section of the channel.

13. A pump according to claim 9 in which the bearing and the shaft are sufficiently close fitting to form seals at opposite sides of the channel to minimize passage of pressurized fluid to and from the channel except through said grooves.

14. A pump according to claim 9 in which seals are formed at opposite sides of the channel by fluid between the bearings and the shaft to minimize passage of pressure fluid to and from the channel except through said grooves.

15. A pump according to claim 9 in which the shaft has a flange and collars at opposite faces of the hub, the grooves leading to and from the channels being formed in the surface of the collars rotatably received in a bore in the body, the assembly on the shaft being secured by a nut threaded on one end of the shaft.

16. A pump according to claim 15 in which seals are formed at opposite sides of the channel between the bores and the collars to minimize passage of pressurized fluid to and from the channel except through the grooves.

17. A pump for viscous fluid comprising; a body having an annular channel formed therein, a central cylindrical bearing disposed in said body concentric with said annular channel, a rotatable shaft disposed in said bearing for substantially closing said annular channel, said shaft having at least one blade fixed thereto and extending radially outwardly from said shaft into said channel, said blade having a cross-sectional shape complementary to the cross-section of said channel, a first groove formed in said shaft adjacent said bearing and extending along said shaft from an inlet into said closed channel entering behind said blade considered in the direction of rotation of said shaft and said blade, a second groove formed in said shaft adjacent said bearing and extending along said shaft from an outlet into said closed channel entering in front of said blade, whereby fluid entering said channel through said first groove behind said blade progressively fills said channel as said shaft and blade are rotated and said advancing blade engages the fluid in front of said blade forcing the fluid through the second groove toward said outlet.

18. A pump as set forth in claim 17 further having a second blade fixed to said shaft diametrically opposed to said one blade and extending radially outwardly from said shaft into said channel, a groove formed in said shaft adjacent said bearing and extending along said shaft from a second inlet into said closed channel entering behind said second blade considered in the direction of rotation of said shaft and said second blade, another groove formed in said shaft adjacent said bearing and extending along said shaft from an outlet into said closed channel entering in front of said second blade, thereby said second blade being so disposed to limit uneven stresses and deflection in shaft.

19. A pump as set forth in claim 17 which comprises a second annular channel formed therein and axially spaced from said one channel, a second blade fixed to said shaft and extending radially outwardly from said shaft into said second channel, said blade having a cross-sectional shape complementary to the cross-section of said second channel, said second groove extending from in front of said one blade to the second channel at a point behind said second blade, and a third groove formed in said shaft from an outlet into said second channel.

20. A pump as set forth in claim 17 in which said bearing and said shaft are sufficiently close fitting to form seals at opposite sides of said channel to minimize passage of pressurized fluid to and from said channel except through said grooves.

21. A pump as set forth in claim 17 in which seals are formed at opposite sides of said channel by fluid between said bearing and said shaft to minimize passage of pressurized fluid to and from said channel except through said grooves.

* * * * *